US009909788B2

(12) United States Patent
Shin et al.

(10) Patent No.: US 9,909,788 B2
(45) Date of Patent: Mar. 6, 2018

(54) DEHUMIDIFIER FOR A VEHICLE LAMP

(71) Applicant: Hyundai Motor Company, Seoul (KR)

(72) Inventors: Jik Soo Shin, Incheon (KR); Keon Soo Jin, Ulsan (KR); Jin Ho Na, Gyeonggi-do (KR); Ki Hong Lee, Seoul (KR); Byoung Suk Ahn, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 173 days.

(21) Appl. No.: 14/938,669

(22) Filed: Nov. 11, 2015

(65) Prior Publication Data

US 2017/0074556 A1 Mar. 16, 2017

(30) Foreign Application Priority Data

Sep. 10, 2015 (KR) ..... 10-2015-0128593

(51) Int. Cl.

| | |
|---|---|
| ***F25B 21/02*** | (2006.01) |
| ***F21S 8/10*** | (2006.01) |
| ***F25B 21/04*** | (2006.01) |

(52) U.S. Cl.

CPC ..... *F25B 21/02* (2013.01); *F21S 48/34* (2013.01); *F25B 21/04* (2013.01)

(58) Field of Classification Search

CPC ..... F21S 48/335; F21S 48/332; F21S 48/34; F21V 31/03; B60H 3/024

See application file for complete search history.

(56) References Cited

U.S. PATENT DOCUMENTS

2015/0070927 A1* 3/2015 Kurahashi ..... F21S 48/335 362/546

FOREIGN PATENT DOCUMENTS

| | | | | |
|---|---|---|---|---|
| DE | 102006028295 | A1 * | 12/2007 | ..... F21S 48/34 |
| JP | 1993-092904 | U | 12/1993 | |
| JP | 2000-146220 | A | 5/2000 | |
| JP | 2002-210321 | A | 7/2002 | |
| JP | 2008-254618 | A | 10/2008 | |
| JP | 2009-021245 | A | 1/2009 | |
| KR | 20-0122066 | Y1 | 10/1998 | |
| KR | 10-2012-0088335 | A | 8/2011 | |
| KR | 10-1250711 | B1 | 4/2013 | |
| KR | 10-2013-0048540 | A | 5/2013 | |
| KR | 10-1371755 | B1 | 3/2014 | |

* cited by examiner

*Primary Examiner* — Elizabeth Martin

(74) *Attorney, Agent, or Firm* — Mintz Levin Cohn Ferris Glovsky and Popeo, P.C.; Peter F. Corless

(57) ABSTRACT

A dehumidifier for a vehicle lamp is provided which includes, a dehumidification case that is coupled to a lamp housing through the interior and exterior of the lamp. The dehumidifier includes a plurality of connected chambers and a suction path connected to the interior of the lamp and a discharge path connected to the exterior of the lamp. Further, a thermoelement is coupled to the connection part and has a first and second surface exposed to different chambers. An absorbent is disposed within the chambers and a valve is disposed within the suction path and the discharge path. A controller is configured to adjust the supply and direction of current and open and close the valve. The dehumidifier continuously removes moisture formed within the lamp, while alternately drying an absorbent disposed within a first chamber and an absorbent disposed within a second chamber using a thermoelement.

8 Claims, 2 Drawing Sheets

DEHUMIDIFIER FOR A VEHICLE LAMP

CROSS REFERENCE TO RELATED APPLICATION

The present application claims priority to Korean Patent Application No. 10-2015-0128593, filed Sep. 10, 2015, the entire contents of which is incorporated herein for all purposes by this reference.

BACKGROUND

Field of the Invention

The present invention relates to a dehumidifier for a vehicle lamp, and more particularly, to a dehumidifier a vehicle lamp that continuously removes moisture formed in the lamp using an absorbent and a thermoelement.

Description of the Related Art

Generally, moisture formed within a head lamp mounted on a vehicle is caused by a difference between internal and external temperatures of a lens. For example when the head lamp is turned on or the internal temperature of the head lamp increases due to engine heat, the air temperature within the head lamp increases, and contains a larger amount of moisture. In particular, exposure to a cold fluid such as a natural fluid (e.g., rain, snow, ice) or an artificial fluid (e.g., car wash fluid or water) directly cools down the lens and, the temperature of the interior surface of the lens is reduced below the dew point. Accordingly, the moisture condenses on the lens and moisture formed on the lens degrades optical efficiency, and reduces the lifetime of the lens.

Therefore, technology for removing moisture formed on the lamp has been developed. For example, some exemplary techniques used to remove moisture formed on the lamp include forming a vent that passes through the interior and exterior of the lamp. The vent hole allows for a smooth air flow within the lamp. Accordingly, the moisture formed on the lamp is rapidly removed. However, when the lamp has a complex internal shape, the dehumidification effect may be degraded since the air flow within the lamp is not evenly distributed even through the vent is formed. In particular, the vent may become clogged with foreign matters thereby significantly degrading the dehumidification effect.

Another example of the technology is to install an absorbent in a lamp. The method of installing an absorbent has an improved dehumidification effect compared with the method of forming a vent. However, the recycle time required to dry the absorbent by the internal heat of the lamp increases with time. Thus, the dehumidification effect is degraded with time. In some instances, the absorbent may expel moisture contained therein, thereby accelerating the formation of moisture.

The above information disclosed in this section is intended merely to aid in the understanding of the background of the invention, and therefore may contain information that does not form the related art that is already known to those of ordinary skilled in the art.

SUMMARY

The present invention provides a dehumidifier for a vehicle lamp, and may include an absorbent and a thermoelement. The device may actively recycle the absorbent using the thermoelement and may continuously remove moisture formed in the lamp. Additionally, the dehumidification performance may be improved and the moisture absorbing performance may be constantly maintained.

In an exemplary embodiment, a dehumidifier for a vehicle lamp may include, a dehumidification case coupled to a lamp housing to pass through the interior and exterior of the lamp. The dehumidifier for the lamp may include a plurality of chambers connected to each other and the plurality of chambers may each include a suction path connected to the interior of the lamp and a discharge path connected to the exterior of the lamp. Further, a thermoelement may be coupled to the connection part between the chambers and may have a first surface and a second surface exposed to different chambers. An absorbent may be disposed within the chambers and a valve may be disposed within the suction path and the discharge path. A controller may be configured to adjust the current supply to the thermoelement and the direction of current supply and may be configured to open and close the valve.

In some exemplary embodiments, the plurality of chambers may include first and second chambers, and the first and second chambers may be connected by a connection path. The thermoelement may be coupled (e.g., fixed) to the connection path, and may include a first surface exposed to the first chamber and a second surface exposed to the second chamber. Each of the first and second chambers may include a suction path and a discharge path formed therein.

The controller may include a power supply unit configured to adjust the current supply to the thermoelement and the direction of current supply and a valve control unit configured to open and close the valve. The valve may include a first suction valve and a first discharge valve disposed within the suction path and the discharge path of the first chamber, respectively; and a second suction valve and a second discharge valve disposed within the suction path and the discharge path of the second chamber, respectively.

When the first surface of the thermoelement exposed to the first chamber becomes a heat absorbing surface and the second surface of the thermoelement exposed to the second chamber becomes a heat generating surface according to the direction of the current supplied to the thermoelement, the first suction valve and the second discharge value may be opened and the first discharge valve and the second suction valve may be closed, according to the adjustments of the controller. When the first surface of the thermoelement exposed to the first chamber becomes a heat generating surface and the second surface of the thermoelement exposed to the second chamber becomes a heat absorbing surface according to the direction of current supplied to the thermoelement, the first suction valve and the second discharge value may be closed and the first discharge valve and the second suction valve may be opened, according to adjustments of the controller.

According to an exemplary embodiment, the dehumidifier may actively recycle the absorbent using the thermoelement, and dehumidify moisture within the lamp. For example, the absorbent in the first chamber and the absorbent in the second chamber may be alternately utilized thereby constantly maintaining the dehumidification performance of the absorbent. Additionally, the moisture formed in the lamp may be continuously removed, and the dehumidification performance may be significantly improved.

BRIEF DESCRIPTION OF THE DRAWINGS

The above and other objects, features and other advantages of the present disclosure will be more clearly understood from the following detailed description when taken in conjunction with the accompanying drawings.

DETAILED DESCRIPTION

Figure 1:
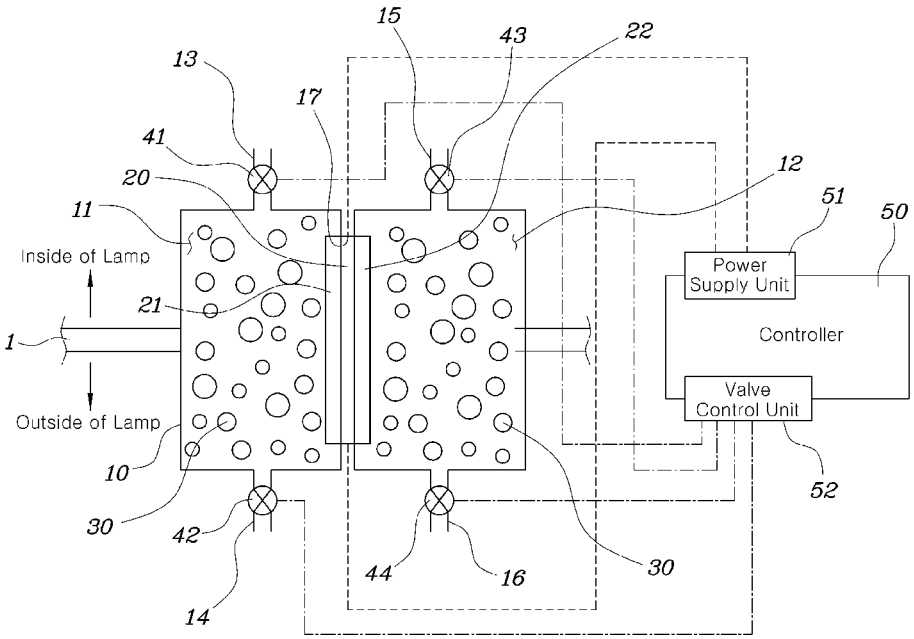
FIG. 1 is an exemplary diagram for describing a dehumidifier for a vehicle lamp according to an exemplary embodiment of the present invention.

Hereinafter reference will now be made in detail to various exemplary embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/of" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

Furthermore, control logic of the present invention may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

Figure 2:
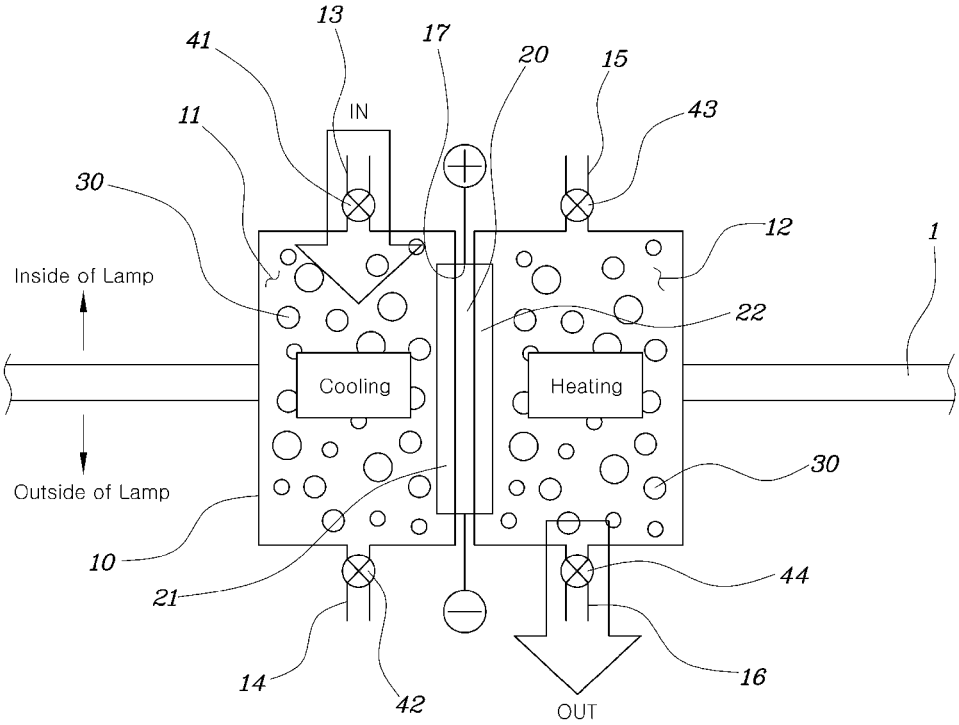
FIG. 2 is an exemplary diagram for describing an operation state of the dehumidifier according to an exemplary embodiment of the present invention.
Figure 3:
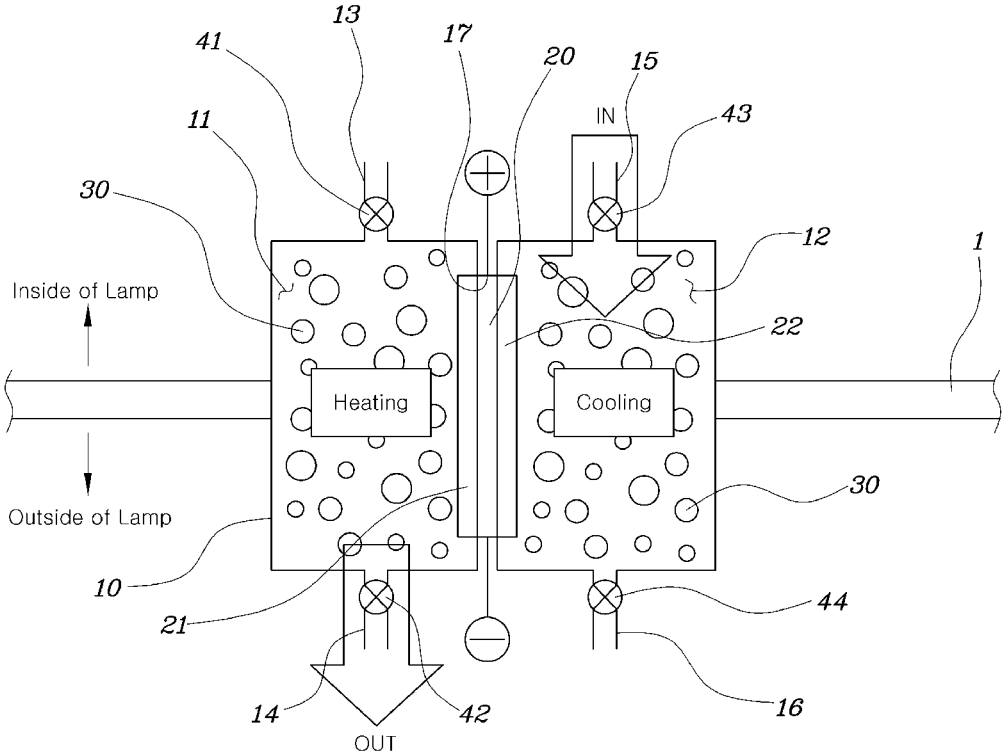
FIG. 3 is an exemplary diagram for describing an operation state of the dehumidifier according to an exemplary embodiment of the present invention.

As illustrated in FIGS. 1 to 3, a dehumidifier for a vehicle lamp according to an exemplary embodiment may include a dehumidification case 10 that may include a plurality of chambers 11 and 12 coupled to a lamp housing 1 to pass through the interior and exterior of the lamp and connected to each other. The plurality of chambers 11 and 12 may include suction paths 13 and 15 connected to the interior of the lamp and discharge paths 14 and 16 connected to the exterior of the lamp. Further, a thermoelement 20 may be coupled to the connection part disposed between the chambers 11 and 12 and may include a first surface and a second surface exposed to the respective chambers 11 and 12. An absorbent 30 may be filled within the chambers 11 and 12 and valves 41 to 44 may be disposed within the suction paths 13 and 15 and the discharge paths 14 and 16. A controller 50 may be configured to adjust a current supply to the thermoelement 20 and the direction of the current supply and open and close the valves 41 to 44.

The absorbent 30 may include a material having a property of absorbing or adsorbing water. Examples of a solid absorbent may include calcium chloride, silica gel, activated alumina and the like, and examples of a liquid absorbent may include lithium chloride, triethylene glycol and the like. When a direct current (DC) voltage is applied across two different thermoelements, the first surface of the thermoelement 20 may absorb heat and the second surface may generate heat, based on the direction of the current. The thermoelement 20 may be a Peltier element or a thermoelectric module.

The plurality of chambers may include first and second chambers 11 and 12. The first and second chambers 11 and 12 may be connected by a connection path 17. Further, the thermoelement 20 may be coupled to the connection path 17 and may include a structure having to first surface 21 exposed to the first chamber 11 and a second surface 22 exposed to the second chamber 12. Each of the first and second chambers 11 and 12 may include a suction path and a discharge path formed therein. The first suction path 13 and the first discharge path 14 of the first chamber 11 may be formed opposite (e.g., facing each other) each other, and the second suction path 15 and the second discharge path 16 of the second chamber 12 may be formed opposite (e.g., facing) each other.

The controller 50 may include a power supply unit 51 for configured to adjust the current supply to the thermoelement 20 and the direction of the current supply and a valve control unit 52 for configured to open and close the valves 41 to 44. The valves may include a first suction valve 41 and a first discharge valve 42 disposed within the first suction path 13 and the first discharge path 14 of the first chamber. The valves may further include a second suction valve 43 and a second discharge valve 44 disposed within the second suction path 15 and the second discharge path 16 of the second chamber 12.

Hereafter, the operation of the dehumidifier according to an exemplary embodiment will be described. In particular, a current may be passed in the forward direction and supplied to the thermoelement 20 according to adjustments of the controller 50 as illustrated in FIG. 2. The first surface 21 of the thermoelement 20 may be exposed to the first chamber 11 and may become a heat absorbing surface, and the second surface 22 of the thermoelement 20 may be exposed to the second chamber 12 and may become a heat generating surface. Based on the adjustments of the controller 50, the first suction valve 41 of the first chamber 11 and the second discharge valve 44 of the second chamber 12 may be opened, and the first discharge valve 42 of the first chamber 11 and the second suction valve 43 of the second chamber 12 may be closed.

The first surface 21 of the thermoelement 20 exposed to the first chamber 11 may be rapidly cooled and may become the heat absorbing surface. Additionally, the moisture within the lamp may be introduced to the first chamber 11 through the first suction path 13 and may be absorbed by the absorbent 30 disposed within the first chamber 11. The second surface 22 of the thermoelement 20 may be heated by the absorbed heat and may heat the absorbent 30 disposed within the second chamber 12. The heated absorbent 30 disposed within the second chamber 12 may discharge the moisture contained therein to the exterior of the lamp through the second discharge path 16.

As shown in FIG. 2 when dehumidification process continues for a predetermined time, the moisture absorbing function of the absorbent 30 in the first chamber 11 may be gradually degraded. In particular, the direction of the current supplied to the thermoelement 20 may be adjusted to the opposite direction. In other words, when the current passes in the opposite direction and is supplied to the thermoelement by the controller 50 as illustrated in FIG. 3, the second surface 22 of the thermoelement 20 exposed to the second chamber 12 may become a heat absorbing surface, and the first surface 21 of the thermoelement 20 exposed to the first chamber 11 may become a heat generating surface. Furthermore, according to the adjustment of the controller 50, the first suction valve 41 of the first chamber 11 and the second discharge valve 44 of the second chamber 12 may be closed, and the first discharge valve 42 of the first chamber 11 and the second suction valve 43 of the second chamber 12 may be opened.

For example when the second surface 22 of the thermoelement 20 exposed to the second chamber 12 is rapidly cooled down and becomes a heat absorbing surface; the humidity within the lamp may be introduced into the second chamber 12 through the second suction path 15, and may be absorbed by the absorbent 30 disposed within the second chamber 12. Furthermore, the first surface 21 of the thermoelement 20 may be heated by the absorbed heat, and thereby heats the absorbent 30 disposed within the first chamber 11. The heated absorbent 30 in the first chamber 11 may discharge moisture contained therein to the exterior of the lamp through the first discharge path 14. When the state illustrated in FIG. 3 continues for a predetermined time, the moisture absorbing function of the absorbent 30 in the second chamber 12 may be gradually degraded. Accordingly, the direction of the current supplied to the thermoelement 20 may be adjusted to the forward direction, to alter the function to the state illustrated in FIG. 2.

As described above, the dehumidifier according to an exemplary embodiment dehumidifies moisture disposed within the lamp by alternatively utilizing the absorbent 30 in the first chamber 11 and the absorbent 30 in the second chamber 12. Compared to the conventional dehumidifier using an absorbent, the dehumidifier according to the exemplary embodiment does not require a recycle time during which the absorbent is dried for reuse. The dehumidifier may constantly maintain the dehumidification performance. Furthermore, the dehumidifier may actively recycle the absorbent 30 using the thermoelement 20. The dehumidifier may continuously extract moisture formed within the lamp through the absorbent 30, thereby significantly improving the dehumidification performance.

While this invention has been described in connection with what is presently considered to be exemplary embodiments on the contrary, it is intended to cover various modifications and equivalent arrangements, without departing from the scope and spirit of the invention as disclosed in the accompanying claim. In addition, it is to be considered that all of these modifications and alterations fall within the scope of the present invention.

What is claimed is:

1. A dehumidifier of a vehicle lamp, comprising:

a dehumidification case coupled to a lamp housing to pass through the interior and exterior of the lamp and having a plurality of chambers connected to each other, wherein the plurality of chambers include a suction path connected to the interior of the lamp and a discharge path connected to the exterior of the lamp;

a thermoelement coupled to a connection path between the chambers and having a first surface and a second surface exposed to different chambers;

an absorbent filled within the chambers;

a valve disposed in the suction path and the discharge path; and a controller configured to supply current to the thermoelement and the direction of current supply and a function of controlling opening/closing of the valve, wherein the plurality of chambers includes first and second chambers, and the first and second chambers are connected through the connection unit.

2. The dehumidifier of claim 1, wherein the thermoelement is coupled to the connection path, and has the first surface exposed to the first chamber and the second surface exposed to the second chamber.

3. The dehumidifier of claim 1, wherein each of the first and second chambers includes the suction path and the discharge path formed therein.

4. The dehumidifier of claim 1, wherein the controller includes a power supply unit configured to adjust current supply to the thermoelement and the direction of current supply; and a valve control unit configured to open and close the valve.

5. The dehumidifier of claim 1, wherein the valve includes a first suction valve and a first discharge valve disposed within the suction path and the discharge path of the first chamber, respectively; and a second suction valve and a second discharge valve disposed within the suction path and the discharge path of the second chamber, respectively.

6. The dehumidifier of claim 5, wherein when the first surface of the thermoelement exposed to the first chamber becomes a heat absorbing surface and the second surface of the thermoelement exposed to the second chamber becomes a heat generating surface based on the direction of the current supplied to the thermoelement, the first suction valve and the second discharge value are opened and the first discharge valve and the second suction valve are closed, according to an adjustment of the controller.

7. The dehumidifier of claim 5, wherein when the first surface of the thermoelement exposed to the first chamber becomes a heat generating surface and the second surface of the thermoelement exposed to the second chamber becomes a heat absorbing surface based on the direction of current supplied to the thermoelement, the first suction valve and the second discharge value are closed and the first discharge valve and the second suction valve are opened, according to an adjustment of the controller.

8. A method for dehumidifying a vehicle lamp, comprising:

supplying by a current to a thermoelement based on an adjustment of a controller;

adjusting a temperature of a first surface of the thermoelement in first chamber wherein the first surface becomes a heat absorbing surface;

adjusting a temperature of a second surface of the thermoelement in a second chamber wherein the second surface becomes a heat generating surface;

adjusting the controller, a first suction valve of the first chamber and a second discharge valve of the second chamber to an opened position, and a first discharge valve of the first chamber and a second suction valve of the second chamber to a closed position.

* * * * *